United States Patent [19]

Parker et al.

[11] Patent Number: 5,074,461

[45] Date of Patent: Dec. 24, 1991

[54] CONTAINER

[75] Inventors: Alan Parker, Maidstone; Bernard Sams, North Finchley, both of England

[73] Assignee: Reed Packaging Limited, England

[21] Appl. No.: 613,896

[22] PCT Filed: May 11, 1989

[86] PCT No.: PCT/GB89/00513

§ 371 Date: Dec. 6, 1990

§ 102(e) Date: Dec. 6, 1990

[87] PCT Pub. No.: WO89/10873

PCT Pub. Date: Nov. 16, 1989

[30] Foreign Application Priority Data

May 11, 1988 [GB] United Kingdom ..... 8811094

[51] Int. Cl.[5] ..... B65D 43/22

[52] U.S. Cl. ..... 229/125.13; 229/125.26; 229/125.32; 229/117.16; 220/245; 220/318

[58] Field of Search ..... 229/125.03, 125.13, 229/125.19, 125.26, 125.28, 125.32, 117.15, 117.16, 117.17, 117.18, 117.24, 117.25; 220/249, 250, 251, 245, 242, 243, 318, 94 R

[56] References Cited

U.S. PATENT DOCUMENTS

| | | | |
|---|---|---|---|
| 2,191,291 | 2/1940 | Smith | 229/117.16 |
| 2,340,394 | 2/1944 | Limbert et al. | 229/125.32 |
| 2,347,980 | 5/1944 | Apfelbaum | 220/343 |
| 2,507,978 | 5/1950 | Jubin | 229/125.28 |
| 2,597,848 | 5/1952 | Reeser | 229/125.28 |
| 2,869,769 | 1/1959 | Robinson | 229/117.16 |
| 2,961,143 | 11/1960 | Forrer | 229/117.17 |
| 3,110,436 | 11/1963 | Wagner | 229/125.26 |
| 3,279,676 | 10/1966 | Cornish | 229/117.16 |
| 3,416,701 | 12/1968 | Kramer et al. | 220/318 |
| 3,659,774 | 5/1972 | Mielke | 229/117.16 |
| 3,741,433 | 6/1973 | Bentley et al. | 220/318 |
| 3,850,334 | 11/1974 | Wharton | 220/243 |
| 4,046,309 | 9/1977 | Poggiali | 229/125.28 |
| 4,359,183 | 11/1982 | Aida et al. | 229/117.16 |
| 4,360,123 | 11/1982 | Blease | 220/318 |
| 4,657,176 | 4/1987 | Matsubara | 229/125.32 |
| 4,775,097 | 10/1988 | Katzman | 229/125.32 |
| 4,787,515 | 11/1988 | Stoll | 206/509 |

FOREIGN PATENT DOCUMENTS

| | | | |
|---|---|---|---|
| 2411495 | 9/1974 | Fed. Rep. of Germany | 229/125.28 |
| 2102115 | 4/1972 | France . | |
| 0700311 | 1/1966 | Italy | 229/125.28 |
| 181810 | 11/1979 | New Zealand . | |
| 184951 | 5/1980 | New Zealand . | |
| 1526346 | 9/1978 | United Kingdom . | |
| 2066214 | 7/1981 | United Kingdom . | |

*Primary Examiner*—Stephen Marcus
*Assistant Examiner*—Christopher McDonald
*Attorney, Agent, or Firm*—Bacon & Thomas

[57] ABSTRACT

A unit (3) for fitting on the open top of a container (1) made of cardboard, corrugated board or similar light-weight semi-rigid sheet material, said unit including securing means (10) arranged to be located and secured in an aperture (15) in a side wall of the container, spaced downwardly from the top thereof, to secure the unit to the container, the said securing means being arranged to extend through the said aperture and to protrude inwardly of the container wall, and being formed as a hollow element to define an outwardly opening but inwardly closed hand hole in the container wall, which hand hole is closed off from the container interior. In an alternative form the hand hole is not necessarily inwardly closed, but the securing member is locked in position.

16 Claims, 3 Drawing Sheets

CONTAINER

This invention relates to containers made of cardboard, corrugated board, or similar lightweight semi-rigid sheet material, particularly but not exclusively ones of comparatively large capacity for use in the transportation and storage of goods. Such containers are frequently required to be provided with a removable or openable lid, or at least with a reinforcing whole or part frame around their open top, and the present invention is primarily directed to the provision of an improved unit for providing such a frame, with or without an associated lid.

Viewed from one aspect the invention provides a unit for fitting on the open top of a container made of cardboard, corrugated board or similar lightweight semi-rigid sheet material, said unit including securing means arranged to be located and secured in an aperture in a side wall of the container, spaced downwardly from the top thereof, to secure the unit to the container, the said securing means being arranged to close the said aperture.

With such an arrangement, the aperture in the container wall does not permit the ingress or egress of moisture, liquid or other matter, which is of substantial importance in many conditions of use.

In one form of the invention the said securing means comprises a securing member arranged to extend through the said aperture and to protrude inwardly of the container wall, and being formed as a hollow element to define an outwardly opening but inwardly closed hand hole in the container wall, which hand hole is closed off from the container interior.

Such an arrangement has the further advantage that a user's hand inserted in the said hand hole cannot come into contact with the contents of the container, which is advantageous for various reasons, for example for hygiene, or if the container contents are harmful to the skin.

Preferably the said securing member is substantially cup-shaped.

Preferably the said unit is arranged to fit over and embrace the top edge of the said container wall so as to have parts extending below such top edge both inside and outside of the wall, the said securing member being mounted to one of the said inside or outside parts of the unit and being arranged, when located in the said wall aperture as aforesaid, to make positive locking engagement with the other of the said inside and outside parts.

Viewed from another aspect the invention provides a unit for fitting on the open top of a container made of cardboard, corrugated board or similar lightweight semi-rigid sheet material, which unit is arranged to fit over and embrace the top edge of at least one side wall of the container so as to have parts extending below such top edge both inside and outside of the wall, and including at least one securing member arranged to be located and secured in an aperture in the said wall, spaced downwardly from the top edge thereof, to secure the unit to the container, the said securing member being mounted to one of the said inside or outside parts of the unit, characterised in that said securing member is arranged, when located in the said wall aperture as aforesaid, to make positive locking engagement with the other of said inside and outside parts.

Preferably the said securing member is also arranged to close the said aperture.

Preferably the said locking engagement is such that the unit, having been secured to a container as aforesaid, cannot be removed without damaging it.

Preferably the said securing member is arranged to extend through the container wall and to protrude inwardly of the wall, and is formed as a hollow element to define an outwardly opening but inwardly closed hand hole in the container wall, which hand hole is closed off from the container interior.

A unit according to the invention may comprise a whole frame, with or without an associated lid, in which case at least two of said securing members will be provided, spaced sufficiently from each other around the unit to secure the same to the container in stable fashion, preferably being located on opposite sides thereof. More than two securing members could however be provided if desired, preferably regularly spaced around the unit. The unit may be of any closed shape, to fit a container having an open top of any perimetric shape. Alternatively the unit may simply comprise a part frame in the form of a reinforcing strip for fitting on one wall of container, with only one securing member.

As already mentioned, a unit according to the invention may or may not comprise or be adapted to carry a lid for the container. Thus in one form the unit comprises only a frame, for use in reinforcing the open top of a container. In another form the unit comprises a fixed lid for the container, so that when the lid is to be removed from the container the unit itself must be removed, and in these circumstances the said securing members will be arranged to be secured in readily releasable fashion in the said apertures in the container walls, to enable the unit to be released from the container when desired. In another form the unit comprises a frame carrying a lid which is openable and closable relative to the frame, for example being hinged to the frame, in which case the unit need not be readily releasable from the container once it has been applied thereto, but can indeed be locked in position as previously mentioned. In yet another form the unit may comprise a frame and a separate lid unit, which fits inside the unit for example, with the lid again being openable and closable relative to the unit, and here again the unit can be locked to the container.

In a preferred form of the invention, as already mentioned, the unit is arranged to fit over and embrace the top edge of the container so as to have parts extending below such top edge both inside and outside of the container wall, and the or each said securing member may then be mounted on either the inside or outside of the unit, and arranged to extend through its associated aperture in the container wall and be secured to the outside or inside part of the unit on the other side of the container wall. In some forms of the invention it is not necessary for the securing member to extend substantially proud of the container wall surface on either the inside or outside thereof, but in a preferred form of the invention the or each securing member has a dimension, in the direction in which it extends through the container wall, substantially greater than the wall thickness, so that it stands proud of the wall of the container either internally or externally thereof. Then, if for example the securing member is arranged to extend proud of the container wall externally thereof, it may provide a protruding gripping portion for enabling the container to be lifted and carried. In a particularly preferred embodiment in which the or each securing member is arranged to extend through the container wall from the outside and protrude inwardly of the container, it may, as already mentioned, be formed as a hollow element whereby to define a hand hole in the container wall, again to enable the container to be lifted and carried.

Preferably the or each securing member is hingedly connected to the body of the unit. When, as is preferred, the unit is made of plastics material, the or each securing member may be integrally hinged to the body of the unit by means of a thin web of plastics material.

The scope of the invention also extends to a container made of cardboard, corrugated board or similar lightweight semi-rigid sheet material, and having a unit as set forth above fitted on its otherwise open top.

Preferably the said unit is made of polypropylene or high-density polythene, or other plastics materials having similar properties.

Some embodiments of the invention will now be described by way of example and with reference to the accompanying drawings, in which.

Figure 1:
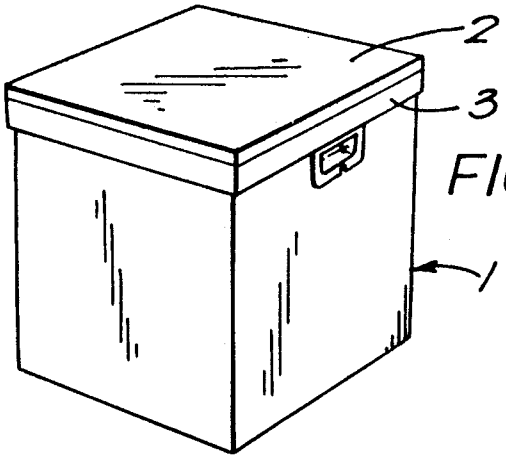
FIG. 1 is a perspective view of a container provided with a lid according to a first embodiment of the invention.
Figure 3:
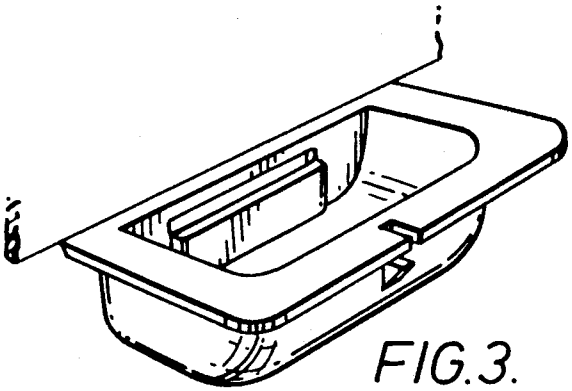
FIG. 3 is a perspective view of one of the securing members of the lid of the container of FIGS. 1 and 2.
Figure 2:
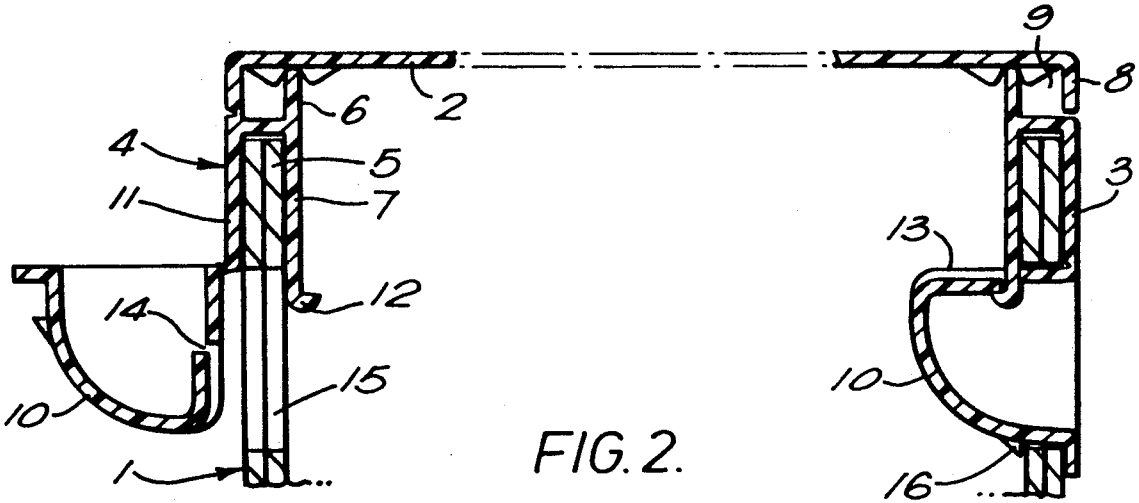
FIG. 2 is a vertical medial cross-sectional view of the top part of the container of FIG. 1.

Referring first to FIGS. 1 to 3, a container according to the invention comprises a large-capacity storage box 1 made of at least double thickness corrugated board and of substantially cubic shape with an open top. Fitted on the open top of the container is a unit comprising a lid 2 hingedly mounted on a frame 3.

Referring particularly to FIG. 2, the frame 3 is a plastics moulding and has a substantially inverted U-shaped body portion 4 extending completely therearound, which is dimensioned to closely embrace the top edge portion 5 of the open top of the container, as shown. The lid 2 is hinged to one side of the frame (at the back as seen in FIGS. 1 and 2) by way of an integral thin web, and the frame is provided with an upstanding portion 6 all around its inside wall 7, on which the lid rests. The lid is formed with a depending skirt portion 8 to close the channel 9 which is thus defined all around the frame.

At two opposite regions, centrally of two of the side walls of the container, the frame is provided with securing members 10 hingedly connected to the bottom edge of its outside wall 11 by way of integral thin webs. In its natural condition, each of the securing members extends outwardly at right angles to the outside wall 11 of the frame, as shown at the left-hand side of FIG. 2. Opposite each of the securing members, the inside wall 7 of the frame is extended downwardly to provide a locking portion 12 for the securing member, whose inner wall is formed with a recess 13 and a slot 14 to engage the locking portion 12 when the securing member is hinged inwardly through a hole 15 in the side wall of the container, as shown at the right hand side of FIG. 2. When it is passed through the hole 15 in this manner, the securing member automatically engages with the locking portion 12 so as to be secured in position. It is further secured by a lug 16 on the underside of the body of the securing member, which engages behind the bottom edge of the hole in the container wall, again as shown at the right-hand side of FIG. 2. As a result, the frame cannot be removed from the container without damaging it.

Each of the securing members is substantially cup-shaped, as shown particularly in FIG. 3, so that when engaged in its secured position it provides an inwardly extending hand hole, one on each side of the container, to enable the same to be lifted and carried. As the interior space of each hand hole is closed off from the container interior, a user's hands cannot come into contact with the container contents.

Figure 4:
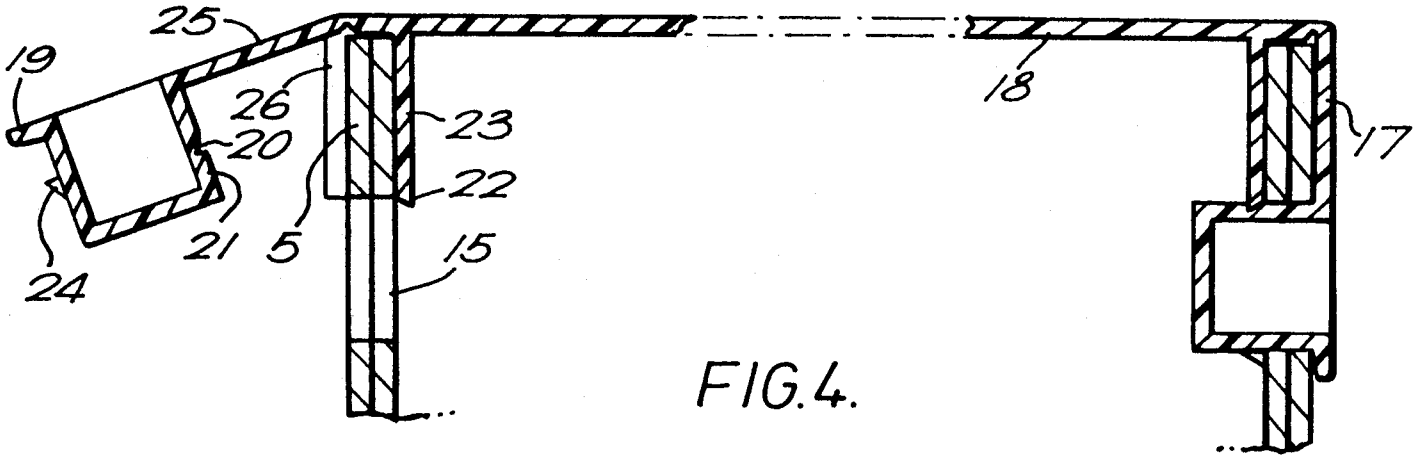
FIG. 4 is a cross-sectional view, similar to FIG. 2, of a second embodiment.

Referring now to the embodiment of FIG. 4, in this embodiment the frame 17 of the unit is substantially similar to that of the first embodiment in its function of embracing the top 5 of the container walls, but differs in that it incorporates an integral, fixed, lid 18 for the container, not a hinged lid as in the first embodiment. Thus in this embodiment, when the lid 18 is to be removed from the container the frame 17 must be removed also, and for this reason the securing members 19 of the frame are readily releasable from the container when desired. Each of the securing members is again formed to provide an inwardly closed hand hole for lifting and carrying the container, but the means for securing the members in position is less positive than in the first embodiment, so as to enable them to be released when it is desired to remove the lid. Specifically, the securing means comprises a groove 20 in the wall 21 of the securing member, which receives a downwardly extending locking portion 22 of the inside wall 23 of the frame, and again the securing member is provided with a further locking lug 24 on its underside. In this embodiment each of the securing members is hinged to the body of the frame 17 together with a movable portion 25 of the outside wall of the frame. The portion 25 is of the same width as its associated securing member; in other words the remaining portions 26 of the outside wall of the frame, outwardly of the portions 25, are not so hingeable but permanently embrace the top portion 5 of the container wall.

In the third embodiment, illustrated in FIG. 5, the frame is again similar to that of FIGS. 1 to 4 in its function of embracing the top of the container walls, but again the arrangement of the lid is different. In this embodiment the lid 27 is a pop-in structure having a skirt 28 which, on one side, is received in mounting brackets 29 on the inside wall 30 of the frame 31, and is hinged by way of integral thin web of plastics on that side. On the other side of the frame a securing lug 32 is provided on the inside wall of the frame, to hold the lid in its closed position. In this embodiment the securing members comprise wall portions 33 forming downward continuations of the outside walls 34 of the frame, hinged thereto by integral plastics webs and arranged to be passed through apertures 15 in the container walls and engaged with locking portions 35 formed on the bottom edges on the inside walls 30 of the frame. In this embodiment, as in the first embodiment, the means for securing the securing members in position is not intended to be releasable without damage, because the lid 27 is openable and closable without removing the frame from the container.

Figure 5:
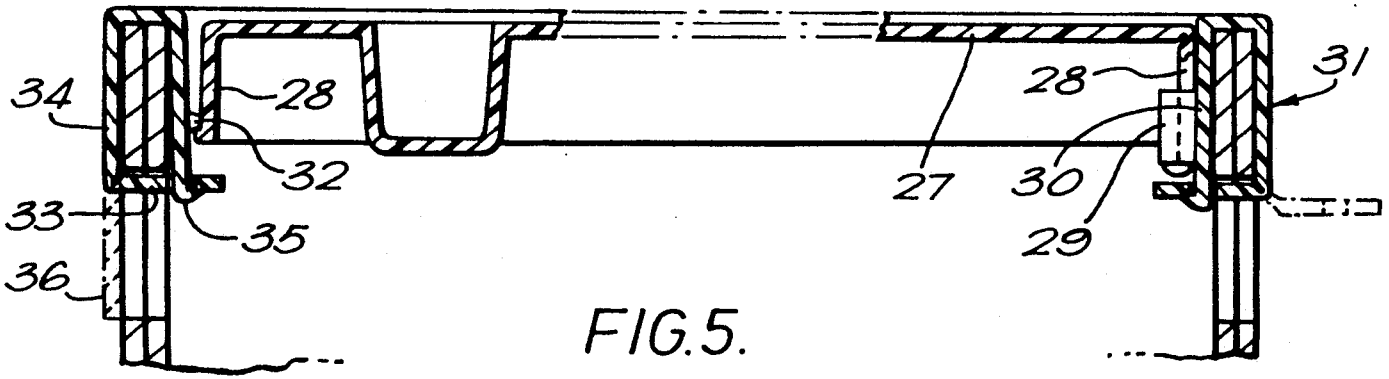
FIG. 5 is a similar cross-sectional view of a third embodiment.

In another embodiment, not illustrated, a frame with an integral lid as shown in FIGS. 1 to 3 may be provided with securing members on all four of its sides, one pair as in FIGS. 1 to 3 to provide inwardly closed hand holes, and another pair as shown in FIG. 5 (for example) so as to provide a particularly secure connection between the frame and the container. In yet another modification, applicable to this latter embodiment or to the embodiment of FIG. 5, the wall portions 33 of the FIG. 5 embodiment are formed with further wall portions 36 at right angles thereto (indicated in ghost lines in FIG. 5) which close the apertures in the container wall to prevent ingress of moisture.

Figure 6:
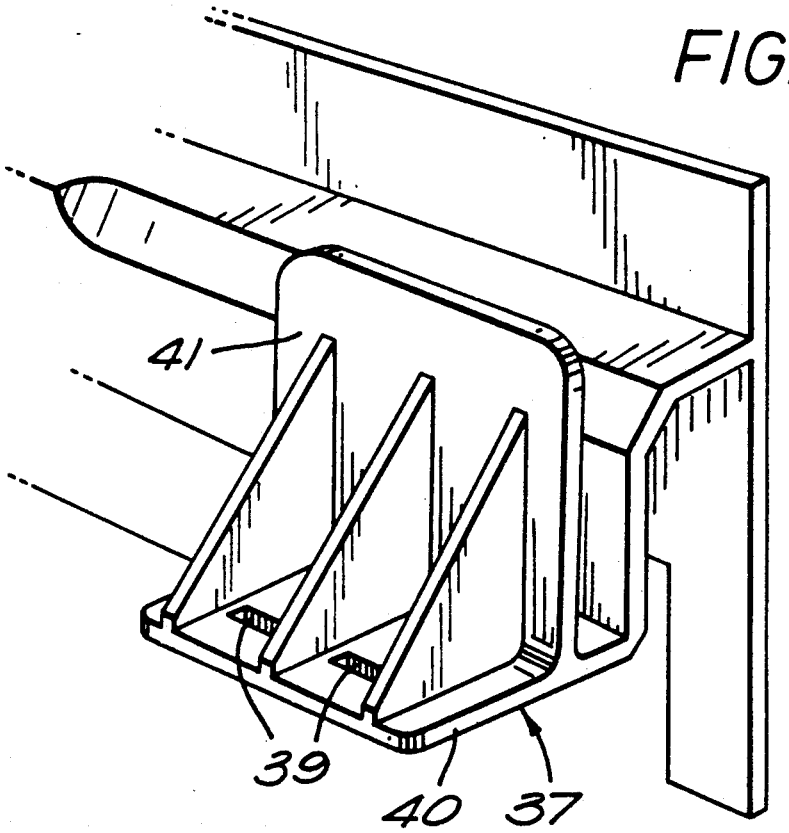
FIGS. 6 and 7 illustrate a fourth embodiment.
Figure 7:
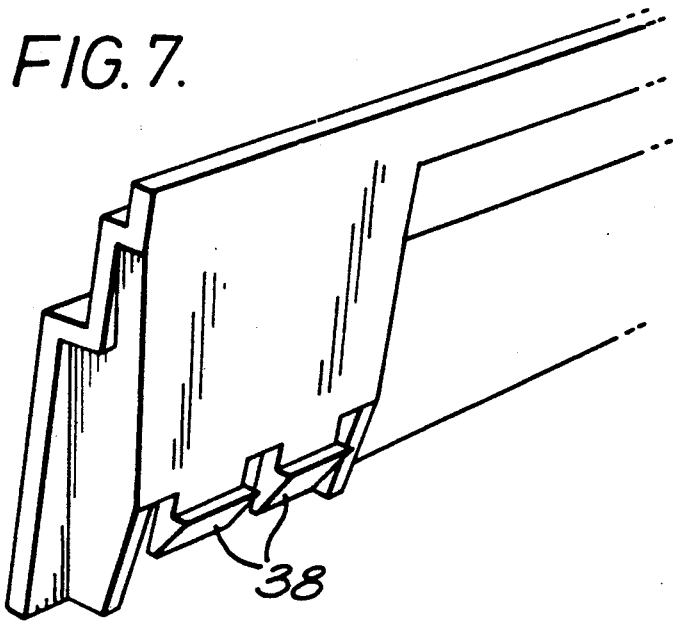

In the embodiment of FIGS. 6 and 7, FIG. 6 shows part of the outer wall of a frame unit (with or without a lid) for securing to a container, seen from the outside, and FIG. 7 shows the adjacent part of the inner wall, seen from the inside. It should be understood that the two walls are integrally connected together as in the previous embodiments. In this embodiment the securing means does not provide a hand hole. The securing member 37 is hingeable inwardly through an aperture in the container wall, through 180° from the position shown in FIG. 6, and is locked in position by the hooks 38 on the inner wall engaging in slots 39 in wall 40 of the securing member. At the same time the wall 41 of the securing member closes the aperture in the container wall.

We claim:

1. A unit for fitting on the open top of a container made of cardboard, corrugated board or similar lightweight, semi-rigid sheet material, said unit comprising securing means arranged to be located and secured in an aperture in a side wall of the container, spaced downwardly from the top thereof, to secure the unit to the container, and wherein said securing means is arranged to close the said aperture, to extend through the said aperture, and to protrude inwardly of the container wall, said securing means being formed as a hollow element to define an outwardly opening but inwardly closed hand hole in the container wall, which hand hole is closed off from the container interior.

2. A unit as claimed in claim 1, wherein the said securing member is substantially cup-shaped.

3. A unit as claimed in claim 1, wherein the said securing means comprises a securing member arranged to extend through the said aperture and a separate closure member for closing the said aperture.

4. A unit as claimed in claim 1, which is arranged to fit over and embrace the top edge of the said container wall so as to have parts extending below such top edge both inside and outside of the wall, the said securing means being mounted to one of the said inside or outside parts of the unit and being arranged, when located in the said wall aperture as aforesaid, to make positive locking engagement with the other of the said inside and outside parts.

5. A unit as claimed in claim 4, wherein the said locking engagement is such that the unit, having been secured to a container as aforesaid, cannot be removed without damaging it.

6. A unit for fitting on the open top of a container made of cardboard, corrugated board or similar lightweight semi-rigid sheet material, which unit is arranged to fit over and embrace the top edge of at least one side wall of the container so as to have parts extending below such top edge both inside and outside of the wall, and said unit comprising at least one securing member arranged to be located and secured in an aperture in the said wall, spaced downwardly from the top edge thereof, to secure the unit to the container, the said securing member being mounted to one of the said inside or outside parts of the unit, and arranged, when located in the said wall aperture as aforesaid, to make positive locking engagement with the other of the said inside and outside parts.

7. A unit as claimed in claim 6, wherein the said locking engagement is such that the unit, having been secured to a container as aforesaid, cannot be removed without damaging it.

8. A unit as claimed in claim 7, wherein the said securing member is also arranged to close said aperture.

9. A unit as claimed in claim 8, wherein the said securing member is arranged to extend through the said aperture and to protrude inwardly of the wall, and is formed as a hollow element to define an outwardly opening but inwardly closed hand hole in the container wall, which hand hole is closed off from the container interior.

10. A unit as claimed in claim 9, wherein the said securing member is substantially cup-shaped.

11. A unit as claimed in claim 1 or 6, wherein the said securing member is hingedly connected to the body of the unit.

12. A unit as claimed in claim 11, said unit being made of plastics material, the said securing member being integrally hinged to the body of the unit by means of a thin web of the plastics material.

13. A unit as claimed in claim 1 or 6, comprising a frame for fitting on the open top of said container, said frame provided with at least two of said securing members at substantially opposite locations in the frame.

14. A unit as claimed in claim 13, wherein the said frame has a lid for the container connected thereto, which lid is openable and closable relative to the frame.

15. A unit as claimed in claim 13, further including a separate lid for the container adapted to be received by the said frame, which lid is openable and closable relative to the frame.

16. A container made of cardboard, corrugated board or similar lightweight semi-rigid sheet material having a unit as claimed in any of claims 1 to 10, 12, 14, or 15 fitted on its otherwise open top.

* * * * *